US005669821A

United States Patent [19]

Prather et al.

[11] Patent Number: 5,669,821

[45] Date of Patent: Sep. 23, 1997

[54] VIDEO AUGMENTED AMUSEMENT RIDES

[76] Inventors: James G. Prather, 18392 Vista Del Lago, Yorba Linda, Calif. 92686; Richard T. Headrick, 5200 Irvine Blvd., Sp. 24., Irvine, Calif. 92720

[21] Appl. No.: 226,902

[22] Filed: Apr. 12, 1994

[51] Int. Cl.[6] ..... A63G 31/16

[52] U.S. Cl. ..... 472/59; 472/60; 104/78; 104/83

[58] Field of Search ..... 472/59, 60, 61; 434/62, 66, 69; 104/77, 78, 83, 84, 105, 53, 55

[56] References Cited

U.S. PATENT DOCUMENTS 4,066,256 1/1978 Trumbull ..... 472/60
4,865,550 9/1989 Chu ..... 104/84 X
4,874,162 10/1989 Trumbull ..... 472/60
4,986,187 1/1991 Booth et al. ..... 104/84
5,336,132 8/1994 Murakami ..... 472/59

*Primary Examiner*—Kien T. Nguyen
*Attorney, Agent, or Firm*—Robbins, Berliner & Carson, LLP

[57] ABSTRACT

An easily modifiable ride is provided with a track and a car for carrying at least one passenger along the track. The track creates changes of movement of the car to thereby produce G-forces to the passenger. A plurality of detectors are provided for detecting movements of the car. At least one display device is used for producing a series of images to create a displayed scenario of an amusement ride. There is also provided signal generators responsive to the detectors for synchronizing between the images and the movements of the car.

29 Claims, 3 Drawing Sheets

VIDEO AUGMENTED AMUSEMENT RIDES

BACKGROUND OF THE INVENTION

1. Field of the Invention

The present invention is related in general to amusement rides of the kind normally found in amusement parks, such as roller coasters, ferris wheels, merry-go-rounds, and the like, and in particular to enhancing the experience provided by such amusement rides.

2. Description of the Related Art

A challenge facing every amusement park is the need to periodically provide fresh attractions in order to maintain attendance at the park.

The excitement which amusement rides create on the passengers (i.e., the combination of a ride along a track, the G-forces produced on the passengers as the car undergoes angular, elevational and speed changes, and the scenery which a ride passes through) have made them an important attraction of every amusement park and the most influential to the park's business.

Because amusement rides are important to a park's business, the need for periodically providing new rides becomes more important. However, the costs required for any renewals, upgrades or remodelings of such rides, including the costs for laying new tracks and/or constructing new landscape, are usually high, especially when any such changes must usually involve safety concerns which make the renewals, upgrades and remodeling more costly.

What is needed is a technique for enhancing and/or increasing the experience provided by amusement rides, and for making it easier to change the rides without having to incur expensive costs of remodelling and reconstruction.

SUMMARY OF THE INVENTION

The excitement of an amusement ride is basically a combination of the sensation caused by the G-forces on the passengers as the cars undergo changes in velocity (due to changes in direction, speed or elevation), and by what is seen and heard by the passengers during the ride. The sensation of the ride can actually be changed if the scenery (i.e., what is seen and heard by the passengers during the ride) is changed, to thereby give the impression of a new ride, even when the track (i.e., the sequence of G-forces produced) remains the same. Furthermore, the scenery can actually be replaced by displaying a series of images and sounds to the passengers to create a displayed scenario, to thereby give the passengers a sensation of a new imaginary ride, provided that the sights and sounds of the displayed scenario are in synchronization with the G-forces so as to enforce rather than diminish the experience of the passengers and the sensation of the imaginary ride.

In a first aspect, the present invention provides a recreational system which has a car for carrying at least one passenger. The car has movements which produce G-forces on the passenger. The system also has means for detecting movements of the car, at least one display device for displaying a series of images to the passenger to create a displayed scenario of an amusement ride, and means responsive to the detecting means for synchronization between the images and the movements of the car.

In another aspect, the present invention provides a method for providing an easily modifiable amusement ride to passengers travelling in a car. The method comprises the steps of displaying a series of images to the passengers to create a displayed scenario of an amusement ride, detecting movements of the car, and synchronizing between the displayed images and the movements of the car.

In still another aspect, the present invention provides a car for carrying one or more passengers along a path or track. The path having means for producing changes in movement of the car to produce G-forces on the passengers in the car. The car has means for detecting movements of the car, a display device for displaying a series of images to the passengers to create a displayed scenario of an amusement ride, and means responsive to the detecting means for synchronization between the images and the movements of the car.

DESCRIPTION OF THE EMBODIMENTS

Figure 1:
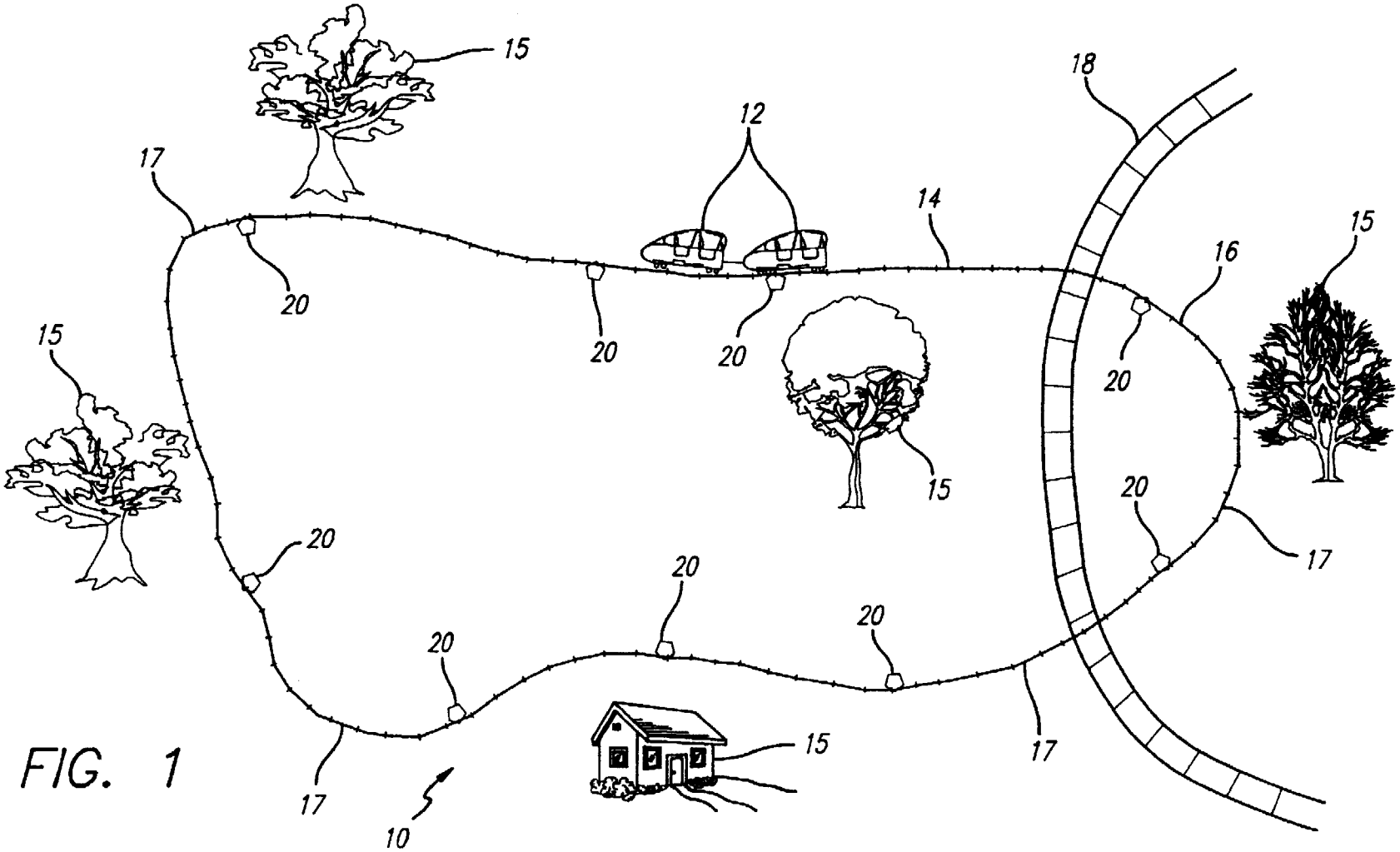
FIG. 1 is a diagram of a roller coaster system in which signal generators are provided for detecting movements of a roller coaster car along the track.

FIG. 1 depicts a roller coaster system 10 which includes a train of one or more cars 12 each carrying one or more passengers along a track 14. Along the track 14 are objects 15 which form the scenery of a conventional ride, that is, the scenery and sounds which would be experienced by a passenger riding in an open car 12. The track 14 also has one or more turns 17 which cause a change in direction of the motion of the cars 12 and one or more changes in elevation 19, each of which will create a change in the velocity of the cars 12 and produce a G-force on the passengers in the cars 12.

Figure 2:
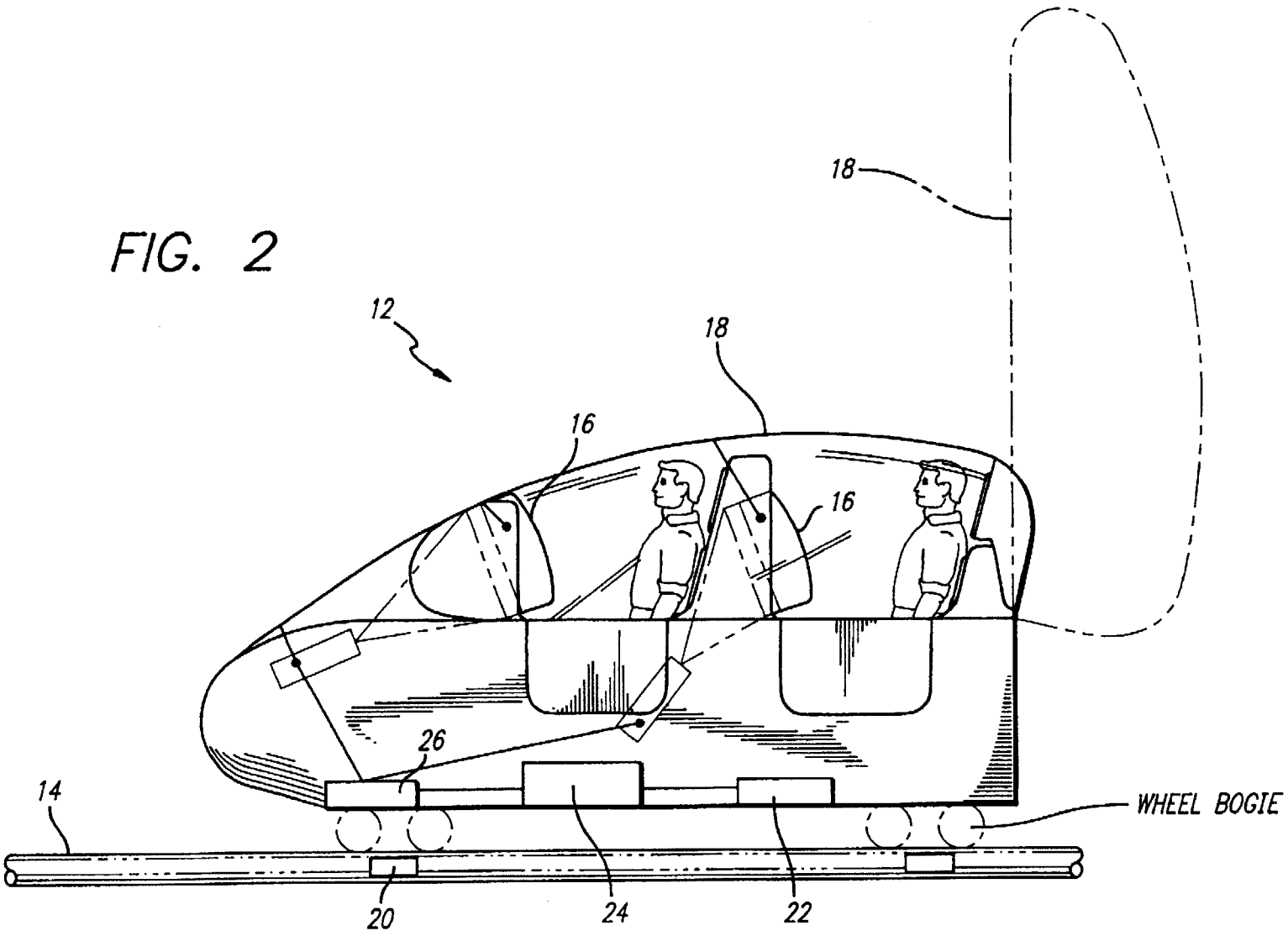
FIG. 2 is a diagram illustrating a design of the roller coaster car used in an embodiment of the present invention.

The external design of each car 12 can be made compatible with the general theme of the amusement park or of the ride. Referring to FIG. 2, one design, for example, is an enclosed bullet car with tilt-up roofs 18 for ingress and egress. Although the external design of each car 12 may vary in accordance with the theme of the ride, the car must be sufficiently enclosed to block the view and/or sounds of the normal scenery 15.

One or more display devices 16, such as computer monitors, liquid crystal displays or projection televisions, are installed in each car 12. The display devices 16 are used to show a sequence of images forming a displayed scenario of an amusement park ride that is different from the actual scenery 15. The images forming a displayed scenario can be transmitted from a remote location, or, as shown in FIG. 2, generated from a video device 26 inside each train or each car 12.

The display device(s) 16 of each train may show the same displayed scenario. Alternatively, the display device(s) 16 of each car 12 may show an individual displayed scenario so that the passengers of different cars may watch different displayed scenarios during the same ride. Alternatively, a display device 16 can be provided to each row of seats of car 12 so that the passengers in each row may watch an individual displayed scenario. If a long train of cars 12 is used, some difference in the display provided to different rows must exist to accommodate the different times at which the various G-forces affect the passengers in the different rows. For a simple example, the first car 12 in a train will experience a change in direction before the last car in the train. The displayed scenario provided to the first row of seats in the first car 12 will therefore show the turn before it is shown to passengers in the last row of the last car 12 of the train.

In another configuration, the display devices 16 can be individually head-mounted displays given to the passengers so that each passenger in the same car 12 may watch an individual displayed scenario during the same ride.

The video device 26 can be a video tape machine, a projector, or a multimedia system retrieving stored images from a CD-ROM. Different displayed scenarios can be stored in individual tapes or CD-ROMs. For example, one displayed scenario can start with a normal view of the actual roller coaster departing the station on a normal ride. The displayed scenario then shows a series of near disasters, and including warning lights and optional indications or audio announcements of partial track collapse ahead. The images can then show the partial destruction of the track 14 and trestle, and the car 12 shooting off into space and becoming a fighter plane, engaging in an aerobatics mode (e.g., flying under bridges and looping over them, flying near skyscrapers and down boulevards) and finally making a landing on an airfield as the car 12 pulls into the station. An alternative displayed scenario can show the roller coaster as being on a pier extending out in a bay, the displayed scenario can then provide the images of the car 12 leaving the track 14 and shooting off into space, but then falling like a bullet into the water, whereupon the displayed scenario will become all underwater for a high speed ride around obstacles (e.g., great white sharks, underwater cliffs, wrecked vessels, and the like) with divers in aqua lungs that tread water in amazement as they watch the car 12 streak by. The displayed scenario may also provide that at the end of the ride, the car 12 shoots up from the water and mystically lands on the track 14 and into the station. Another displayed scenario may provide that from the first movement, the car 12 is an airplane taking off from an airfield in a combat flight, making wild maneuvers to avoid heat-seeking missiles. The "airplane" then locks onto an enemy fighter and follows the enemy fighter in a dog-fight, finally shooting down the enemy fighter in flames, and "limping" back into the airfield for a forced landing.

To provide a "new" roller coaster ride, the displayed scenario can be changed by changing the tape or the CD-ROM in the video device 26.

The images are accompanied by corresponding audio effects of, for example, radio communication, warnings, explosions, etc.

To enhance the reality of a ride, the images shown on the display devices 16 are controlled to be displayed synchronized with the movements of the car 12, and specifically with the G-forces which the passengers will experience during the ride. The G-forces and the audio-visual effects experienced by a passenger can be used to make the passenger feel or experience a particular set of events of a particular displayed scenario. Any lack of synchronism, such as mismatches in either pitch, rotation or acceleration of G-forces perceived by the rider/viewer, could cause discomfort and nausea.

The synchronization is accomplished by, for example, providing a plurality of signal generators 20 at predetermined locations on the track 14, each generating a synchronizing signal. The signal generators 20 can be active sources such as an infrared signal generator, a permanent magnet or a radio wave generator, or passive sources such as devices for breaking a light beam. The signal generators 20 can be placed such that a synchronizing signal is picked up by each car 12 at predetermined time intervals (e.g., one every 5 seconds).

Providing timing marks, such as signals produced by signal generators 20, at fixed time separations rather than at fixed or arbitrary distances, provides advantages in synchronizing the displayed scenario to the G forces experienced by the passengers. It would be disruptive to dramatically change the displayed scenario whenever a synchronization error was detected. By spacing the timing marks at fixed times apart on the track, it is easy to provide a gradual correction so that, for example, the detected error could be corrected by the time the car 12 approached the third or fourth timing mark after the error was detected.

If the marks were spaced at fixed distances along the track, different timing corrections would have to be made between different marks. Three marks at fixed distances from each other might include a first time span when a car 12 was slowly moving toward the top of an incline and a second time interval as the car hurtled down a steep slope. If it was determined to be necessary to slow down the display of the displayed scenario to reduce a synchronization error, only a small amount of slowing down might be required during the first time span, but a larger slowing down would be required because of the shorter time duration of the second span. Because the apparent speed of the displayed scenario is made to match the average or expected speed of the cars 12, timing marks a fixed time apart permit equal error corrections to be made between different time spans even if the speed of the car during the spans is different.

The synchronizing signal is sensed by a sensor 22 inside a predetermined car 12 of each train (e.g., the first car) or inside each car 12. The sensor 22 can be an infrared sensor, a magnetic flux sensor or a radio signal sensor, depending upon the kind of signal generators 20 provided on the track 14. In response to the synchronizing signal, the sensor 22 produces a signal to a computer 24 in each car 12 for controlling the operation of the video devices 26.

Figure 3:
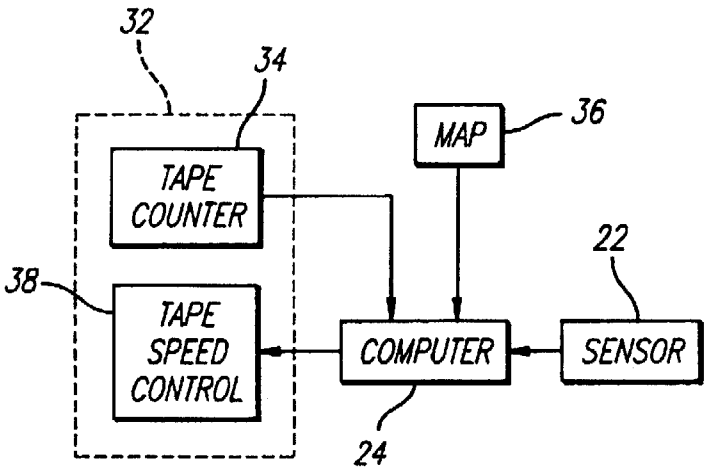
FIG. 3 is a diagram illustrating an implementation of the present invention wherein synchronization is accomplished by adjusting the speed at which the images are displayed.

In one implementation, the speed at which the images are shown is synchronized to the locations of the signal generators 20. With reference to FIG. 3, assume, by way of example, that the images are produced from a variable speed tape device 32 operating under the control of the computer 24. The tape device 32 has a tape counter 34 for indicating the current position of the tape inside the tape device 32. The output of the tape counter 34 is connected to the computer 24. The tape counter 34 is reset to a predetermined value (e.g., "0") at the beginning of the ride and will advance as the car 12 travels through the track 14. Stored in the memory of the computer 24 is a map 36, as illustrated in Table 1, which maps each of the signal generators 20 to a correspondingly expected value of the tape counter 34 (i.e., where the tape should be when a corresponding signal generator 20 is encountered).

TABLE 1

| Signal Generator Number | Tape counter |
|---|---|
| 1 | 135 |
| 2 | 245 |

TABLE 1-continued

| Signal Generator Number | Tape counter |
|---|---|
| 3 | 357 |
| ... | ... |
| 100 | 1056 |

When a specific signal generator 20 is encountered by the car 12, the tape should reach a predefined location and the tape counter 34 should therefore reach a predefined value. If the tape has not reached the predefined location or has overpassed the predefined location, the computer 24 will adjust speed control 38 of the tape device 32 to change the speed of the tape device 32, making the tape device 32 slower if a signal generator 20 is not encountered on time, or faster if a signal generator 20 has already been passed before the correct image is shown. To eliminate the effects which may be caused by sudden changes of tape speed, any increase or decrease of tape speed can be performed over a predetermined time interval, unless the car 12 is approaching a sharp turn or drop when fast adjustment of the tape device 32 becomes necessary in order to produce the correct sequence of images so as to eliminate discomfort.

Figure 4:
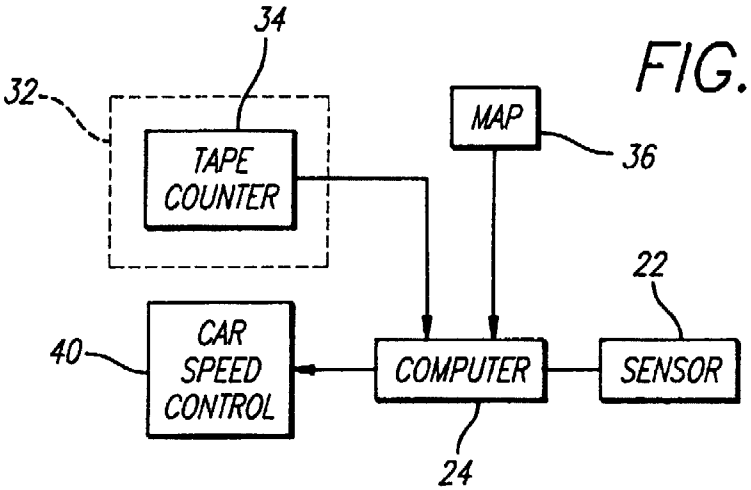
FIG. 4 is a diagram illustrating an implementation of the present invention wherein synchronization is accomplished by adjusting the speed of the roller coaster car.

Referring to FIG. 4, in another implementation, the train can be driven by an internal mechanism 40 (e.g., an individual electric motor) operating under the control of the computer 24. Images displayed on the display devices 16 are generated from the tape device 32. The tape counter 34 of the tape device 32 is connected to the computer 24. Stored in the memory of the computer 24 is a map 36, similar to that shown in Table 1, which maps the images to the signal generators 20. As the signal generators 20 are encountered, the computer 24 checks the tape counter 34 (i.e., the images being shown) to see if the correct image is being shown. If the correct image is not being shown when a corresponding signal generator 20 is encountered, the computer 24 will adjust the speed control 40 of the train to move the train either faster or slower and thereby re-synchronize the position of the train with the tape counter 34 (i.e., the images).

Figure 5:
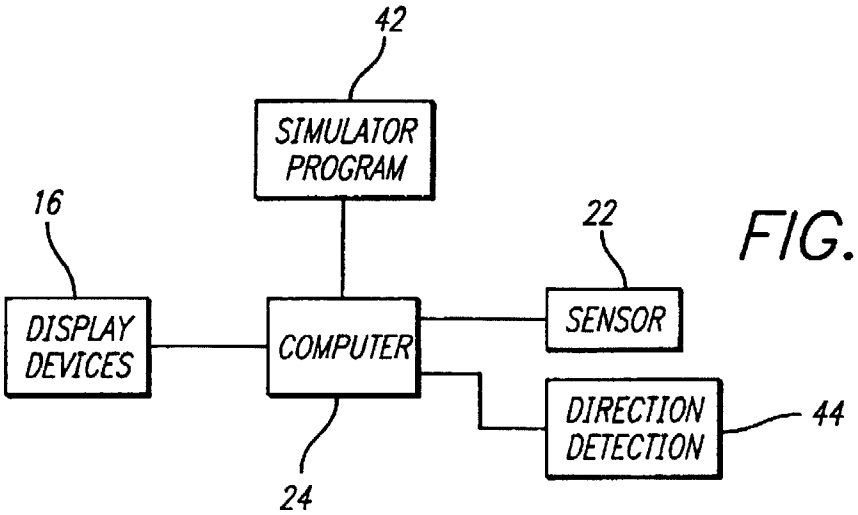
FIG. 5 is a diagram illustrating an implementation of the present invention in which a simulation program is controlled by a direction detector and a position sensor.

Referring to FIG. 5, in another implementation of the present invention, computer 24 may be executing a simulation software 42, such as a flight simulation program, stored in its memory. In addition to the sensor 22 for sensing the signal from the signal generators 20, each car 12 is equipped with a direction detector 44 for detecting angular changes, both vertical and horizontal, of the car 12. Both the output of the direction detector 44 and the output of the sensor 22 are applied to the computer 24, which use these outputs to generate input signal to the simulation software 42, in a similar manner as when a simulation software 42 is controlled by a joystick.

In still another implementation, a force detector can be installed inside each car (or one in each train). The output of the internal force detector can be applied to the computer 24 to control a simulation program which generates the images. Alternatively, the images can be generated from a tape device which operates under the control of a computer 24. The images are mapped to the G-forces of the track 14 and the output of the internal force detector can then be used to synchronize the generation of the images. Under these implementations, there is no need to install signal generators 20 on the track 14.

Instead of synchronizing the images to the G-forces, a ride can be customized to a series of images, such as a series of images taken from a popular movie (e.g., the movie "back to the future"). In this embodiment, the images are already in existence, and a track is then built to produce G-forces based upon the images. The G-forces are produced by creating a track with directional and elevational changes that can produce the appropriate G-forces which the viewers of the images should experience. In other words, in this implementation, the G-forces are made in synchronization with the images.

It will be understood that the scope of this invention is not limited by the design of the above described preferred embodiment. While the invention is described and taught using the preferred embodiment, it will be understood that various changes and modifications can be made therein without departing from the spirit and scope of the invention, which are defined by the following claims.

What is claimed is:

1. A recreational system, comprising:

a car for carrying at least one passenger along a fixed track to produce G-forces on the passenger;

detecting means for generating a synchronizing signal representative of motion of the car as it travels along the track;

at least one display device for displaying a series of stored images to the passenger to create a displayed scenario of an amusement ride; and synchronization means responsive to said detecting means for changing said displayed scenario in response to said movements, to thereby match the displayed scenario to the motion and/or position of the car.

2. A recreational system as in claim 1, wherein the synchronization means further comprises:

means for adjusting the speed of the car.

3. A recreational system as in claim 1, wherein the synchronization means further comprises:

means for adjusting the speed of said display device.

4. A recreational system as in claim 1, wherein said detecting means comprises means for detecting position of the car along the track.

5. A recreational system as in claim 4, wherein each said detecting means comprises an infrared detector.

6. A recreational system as in claim 4, wherein each of said detecting means comprises a magnetic flux sensor.

7. A recreational system as in claim 1, wherein said detecting means comprises means for detecting speed of the car.

8. A recreational system as in claim 1, wherein said detecting means comprises means for detecting G-forces produced on the car.

9. A recreational system as in claim 1, wherein said detecting means comprises a plurality of signal generators located adjacent to said track.

10. A recreational system as in claim 1, wherein the series of images are replaceable.

11. A method for providing a modifiable amusement ride to passengers travelling in a car, comprising the steps of:

displaying a series of stored images to said passenger to create a displayed scenario of an amusement ride;

detecting movements of said car; and changing said displayed stored images in response to said movements of said car.

12. A method as in claim 11, wherein the changing step synchronizes between said images and said movements of the car by adjusting the speed of the car.

13. A method as in claim 11, wherein the changing step synchronizes between said images and said movements of the car by adjusting said displaying step.

14. A method as in claim 11, wherein said movements are detected by detecting position of the car.

15. A method as in claim 11, wherein said movements are detected by detecting speed of the car.

16. A method as in claim 11, wherein said movements are detected by detecting G-forces on the car.

17. A method as in claim 11, wherein said car moves on a track and said detecting step comprises the step of providing a plurality of signal generators at predetermined locations on the track.

18. A method as in claim 11, wherein said car moves on a track and said detecting step comprises the step of generating a signal at predetermined locations on the track.

19. A method as in claim 11, comprising the step of displaying a different set of images to modify the ride.

20. A car for carrying one or more passengers along a path, the path having means for producing changes in movements of the car to produce G-forces on the passengers in the car, the car having:

car-mounted means for detecting said movements of said car;

at least one display device for displaying a series of stored images to said passengers to create a displayed scenario of an amusement ride; and changing means responsive to said car mounted detecting means for changing said stored images in response to said movements of the car.

21. A car as in claim 20, wherein the changing means synchronizes between said images and said movements of said car by adjusting speed of the car.

22. A car as in claim 20, wherein the changing means synchronizes between said images and said movements of said car by adjusting speed of said display device.

23. A car as in claim 20, wherein said car-mounted detecting means comprises detectors for detecting position of the car.

24. A car as in claim 20, wherein said car-mounted detecting means comprises an infrared detector.

25. A car as in claim 20, wherein said car-mounted detecting means comprises a magnetic flux sensor.

26. A car as in claim 20, wherein said car-mounted detecting means comprises detectors for detecting speed of said car.

27. A car as in claim 20, wherein said car-mounted detecting means comprises detectors for detecting G-forces on said car.

28. A car as in claim 20, whereto said car-mounted detecting means comprises a sensor for sensing signals generated at predetermined locations of the path.

29. A car as in claim 20, wherein said series of images are replaceable.

* * * * *